US009097488B2

(12) United States Patent
Zarecky et al.

(10) Patent No.: US 9,097,488 B2
(45) Date of Patent: Aug. 4, 2015

(54) HELICAL PATH PAINTBALL DELIVERY SYSTEM

(71) Applicant: Summit Products Inc., Lake in the Hills, IL (US)

(72) Inventors: Joshua George Zarecky, Carmel, IN (US); Victor Karl Zarecky, Lake in the Hills, IL (US)

( * ) Notice: Subject to any disclaimer, the term of this patent is extended or adjusted under 35 U.S.C. 154(b) by 37 days.

(21) Appl. No.: 13/692,934

(22) Filed: Dec. 3, 2012

(65) Prior Publication Data

US 2013/0146043 A1 Jun. 13, 2013

Related U.S. Application Data

(60) Provisional application No. 61/568,642, filed on Dec. 8, 2011.

(51) Int. Cl.

| | |
|---|---|
| ***F41B 11/00*** | (2013.01) |
| ***F41A 9/00*** | (2006.01) |
| ***F41B 11/02*** | (2006.01) |
| ***F41B 11/52*** | (2013.01) |

(52) U.S. Cl.
CPC ..... *F41B 11/52* (2013.01)

(58) Field of Classification Search
CPC ..... F41B 11/52
USPC ..... 124/41.1, 49, 51.1, 82; 42/49.01
See application file for complete search history.

(56) References Cited

U.S. PATENT DOCUMENTS

| | | | | | |
|---|---|---|---|---|---|
| 4,965,951 | A | * | 10/1990 | Miller et al. | 42/49.01 |
| 5,097,816 | A | * | 3/1992 | Miller | 124/49 |
| 5,166,457 | A | * | 11/1992 | Lorenzetti | 42/49.01 |
| 5,282,454 | A | * | 2/1994 | Bell et al. | 124/49 |
| 5,285,765 | A | * | 2/1994 | Lee | 124/50 |
| 5,335,579 | A | * | 8/1994 | David | 89/34 |
| 5,383,442 | A | * | 1/1995 | Tippmann | 124/76 |
| 5,505,188 | A | * | 4/1996 | Williams | 124/74 |
| 5,520,171 | A | * | 5/1996 | David | 124/51.1 |
| 5,542,570 | A | * | 8/1996 | Nottingham et al. | 221/192 |
| 5,669,369 | A | * | 9/1997 | Scott | 124/73 |
| 5,673,679 | A | * | 10/1997 | Walters | 124/53.5 |
| 5,722,383 | A | * | 3/1998 | Tippmann et al. | 124/76 |
| 5,816,232 | A | * | 10/1998 | Bell | 124/51.1 |
| 5,954,042 | A | * | 9/1999 | Harvey | 124/51.1 |
| 6,109,252 | A | * | 8/2000 | Stevens | 124/51.1 |
| 6,213,110 | B1 | * | 4/2001 | Christopher et al. | 124/51.1 |
| 6,305,367 | B1 | * | 10/2001 | Kotsiopoulos et al. | 124/49 |
| 6,374,819 | B1 | * | 4/2002 | Ming-Hsien | 124/49 |
| 6,408,836 | B1 | * | 6/2002 | Ming-Hsien | 124/49 |
| 6,532,946 | B1 | * | 3/2003 | Paquette | 124/49 |
| 6,591,824 | B2 | * | 7/2003 | Hatcher | 124/56 |
| 6,739,322 | B2 | * | 5/2004 | Rice et al. | 124/49 |
| 6,742,512 | B1 | * | 6/2004 | Ho et al. | 124/49 |
| 6,923,170 | B2 | * | 8/2005 | Ho et al. | 124/49 |
| 7,322,347 | B2 | * | 1/2008 | Broersma | 124/49 |
| D566,791 | S | * | 4/2008 | Broersma | D21/573 |

(Continued)

*Primary Examiner* — Melba Bumgarner
*Assistant Examiner* — Alexander Niconovich

(57) ABSTRACT

This apparatus is a helical path paintball delivery system, comprising a structure with an internal helical type cavity that interfaces between a paintball marker with unique design characteristics preventing the use of alternative hoppers and any paintball hopper, regardless of manufacturer, providing a path for paintballs residing in a player's chosen hopper to flow freely from the hopper through the helical path paintball delivery connector into the firing chamber of the paintball marker.

10 Claims, 7 Drawing Sheets

(56) References Cited

U.S. PATENT DOCUMENTS

| | | | | |
|---|---|---|---|---|
| 7,418,958 | B2 * | 9/2008 | Carpenter et al. | 124/49 |
| 7,431,027 | B2 * | 10/2008 | Carpenter et al. | 124/49 |
| 7,775,199 | B2 * | 8/2010 | Ho | 124/49 |
| 7,966,999 | B2 * | 6/2011 | Bosch et al. | 124/51.1 |
| 8,061,342 | B2 * | 11/2011 | Christopher et al. | 124/51.1 |
| 8,100,119 | B2 * | 1/2012 | Hall | 124/71 |
| RE43,756 | E * | 10/2012 | Christopher et al. | 124/51.1 |
| 8,448,631 | B2 * | 5/2013 | Spicer et al. | 124/51.1 |
| 8,561,600 | B2 * | 10/2013 | Christopher et al. | 124/51.1 |
| 2002/0083936 | A1 * | 7/2002 | Ming-Hsien | 124/49 |
| 2004/0194772 | A1 * | 10/2004 | Hamilton | 124/45 |
| 2007/0012304 | A1 * | 1/2007 | van Dorsser et al. | 124/51.1 |
| 2007/0256676 | A1 * | 11/2007 | Orvis et al. | 124/31 |
| 2008/0236558 | A1 * | 10/2008 | Bosch et al. | 124/48 |
| 2011/0220086 | A1 * | 9/2011 | Bosch et al. | 124/51.1 |

* cited by examiner

HELICAL PATH PAINTBALL DELIVERY SYSTEM

BACKGROUND OF THE INVENTION

This invention relates generally to the field of the fast paced sport of paintball and more specifically to the equipment used in the nuances of the sport; this invention contributes a helical path paintball delivery connector.

In the game of paintball, the player must carry a paintball marker or gun, a paintball propellant source, and paintballs. Players carry their primary supply of paintballs in a device known in the art as a hopper. The hopper is connected to the paintball marker via a mounting point often using an intermediate assembly. The intermediate assembly, henceforth referred to as a connector, provides sufficient retaining strength and allows for flow of paintballs between the hopper and the marker. For example, hopper to paintball marker feed connectors are disclosed in U.S. Pat. Nos. 2003/0213481 A1 and 2007/0089723 A1.

A multitude of hoppers are available with varying shapes, sizes, and electromechanical feed mechanisms. Each hopper style has strengths and weaknesses under certain conditions, applications, and forms of paintball play. Most hoppers available in the art have a similar design whereby a tube protruding from the hopper is used as the point of interaction for the intermediate connector assembly. This common design characteristic allows the player to use a connector designed for any given paintball marker with any of the available hoppers.

Each paintball marker has a connection point that when used with an appropriately designed connector can interface with a conventionally designed hopper. The present invention is more specifically related to the field of the paintball hopper connector.

Some paintball markers use an atypical hopper and connection style, which restricts users to a single or otherwise limited set of hopper options. The known art cannot connect with all paintball markers that are not designed for use with the standard hopper tube connector.

One example of a paintball marker utilizing a unique hopper and connector is disclosed in U.S. Pat. No. 6,739,323 B2. The art has a mechanical paintball feed mechanism internal to the connector, which mates to the paintball marker along its surface. The feed mechanism is driven by the paintball markers propellant supply. The connector has a large diameter opening that attaches to the hopper designed for this application. A mechanical feature protrudes from the face of the marker and fits inside the connector. This feature aids in the control and flow of paintballs into the marker. The unique design of the aforementioned art does not allow players to use any other available hoppers. The present invention provides a connector for use in this and similar applications allowing players to utilize other hopers available in the field of paintball.

In the sport of paintball players have innumerable options for upgrades and improvements to their paintball markers performance. A player can gain many advantages in a game by being able to fire more shots in faster rapid succession. Common among upgrades are hoppers that provide feed mechanisms capable of meeting the paintball feed rate demands of markers outfitted with components such as electronically controlled triggers and high performance valves. By limiting the hoppers available for use, players are inhibited and cannot progress with the advances of the sport.

In contrast to known art, the helical path connector of the present invention is designed to bridge the gap between the unique mating features and mounting configurations of a paintball marker and other hoppers utilizing an incompatible mating design configuration.

The user of the present invention can attach hoppers to the unique marker without destructive or permanent modification to the paintball marker. The design of the connector of the present invention accommodates the paintball markers unique mounting surfaces and features. The helical path and internal geometry through the connector allows paintballs to flow into the marker uninhibited by unique features and design characteristics of the paintball marker.

Users of the present invention gain the freedom to utilize any of the available hoppers available in the known art with a paintball marker that does not accommodate standard hoppers. Users of the present invention can change hoppers as required or desired. By using other hoppers players can optimize their markers performance including rate of fire giving players an edge in the game.

The present invention, henceforth disclosed, contributes to the art a helical path paintball delivery connection system, which makes possible the use of any hopper on paintball markers that do not otherwise permit the use of different hoppers.

BRIEF SUMMARY OF THE INVENTION

The primary object of the invention is a helical path paintball delivery connector comprising a device with an internal cavity defined by a circular cross section swept along a helical type path through the device and any additional pockets and design features necessary for interfacing between a paintball marker employing an atypical hopper mounting configuration and the multitudes of hoppers available in the art. The application of the present invention is to allow players with a marker utilizing an atypical hopper configuration to use a hopper of their choosing. The core function of the invention is to allow paintballs residing in a player's hopper to flow freely from the hopper through the helical path paintball delivery connector into the firing chamber of the paintball marker.

BRIEF DESCRIPTION OF THE SEVERAL VIEWS OF THE DRAWING

The disclosure herein will be described hereafter with reference to the attached drawings of illustrative embodiments of the invention which are given as non-limiting examples, in which.

Corresponding references to features of the embodiment indicate corresponding parts throughout the figures.

DETAILED DESCRIPTION OF THE INVENTION

Detailed descriptions of the preferred embodiment are provided herein. The disclosure of the invention illustrates best mode embodiments. However, it is to be understood that the apparatus of the present invention may be embodied in various forms. Therefore, specific details disclosed herein are not to be interpreted as limiting the scope of the invention in any manner, but rather as a basis for claims and as a representative basis for teaching one skilled in the art to employ the present invention in virtually any appropriately detailed system, structure, or manner.

Figure 1:
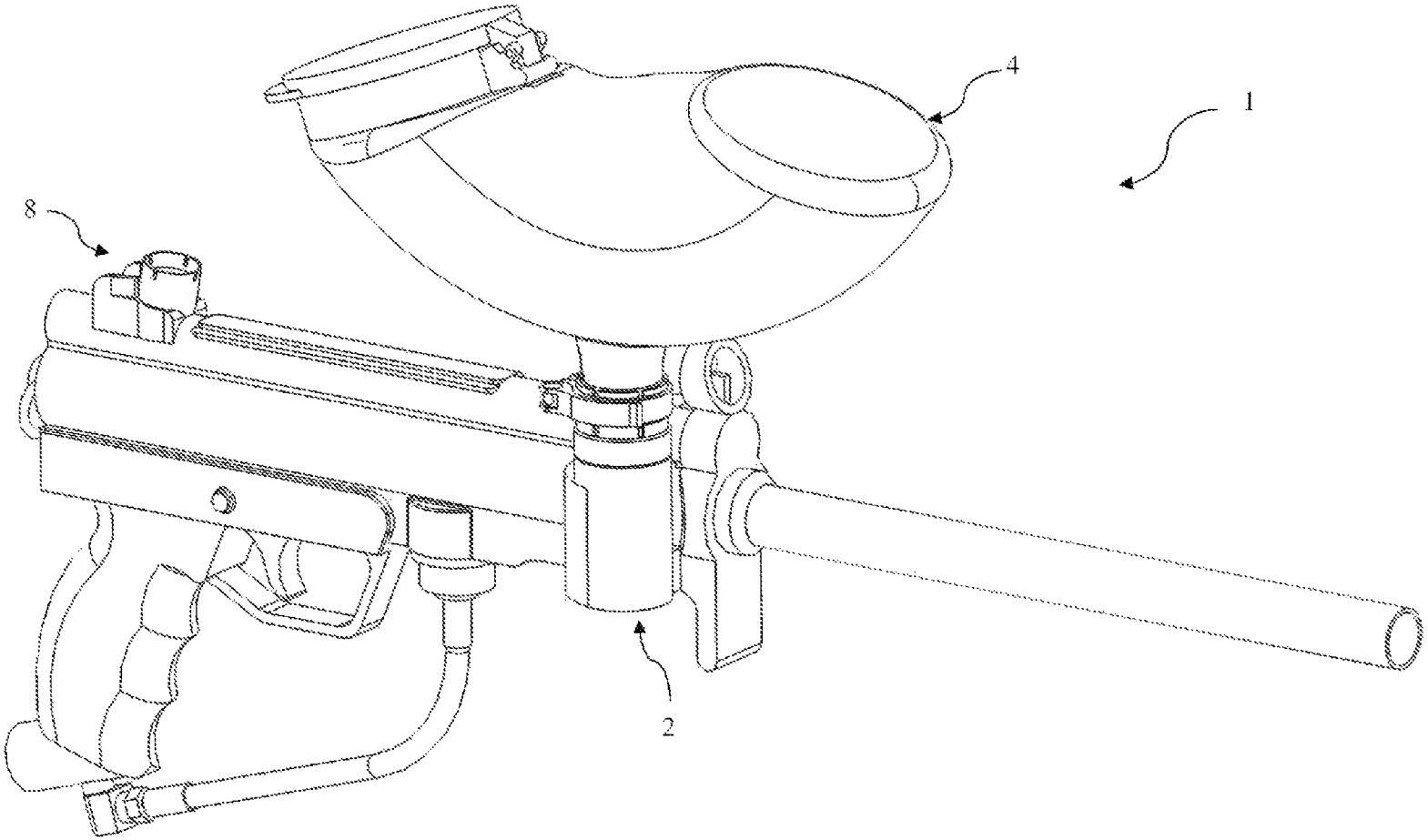
FIG. 1 is a perspective view of a paintball marker with a hopper removably attached via a helical path paintball delivery connection system.

FIG. 1 shows a perspective view of the paintball marker assembly 1, which consists of illustrative embodiments of a paintball marker 8 and a helical path paintball delivery connector 2 with a removably attached hopper 4.

Figure 2:
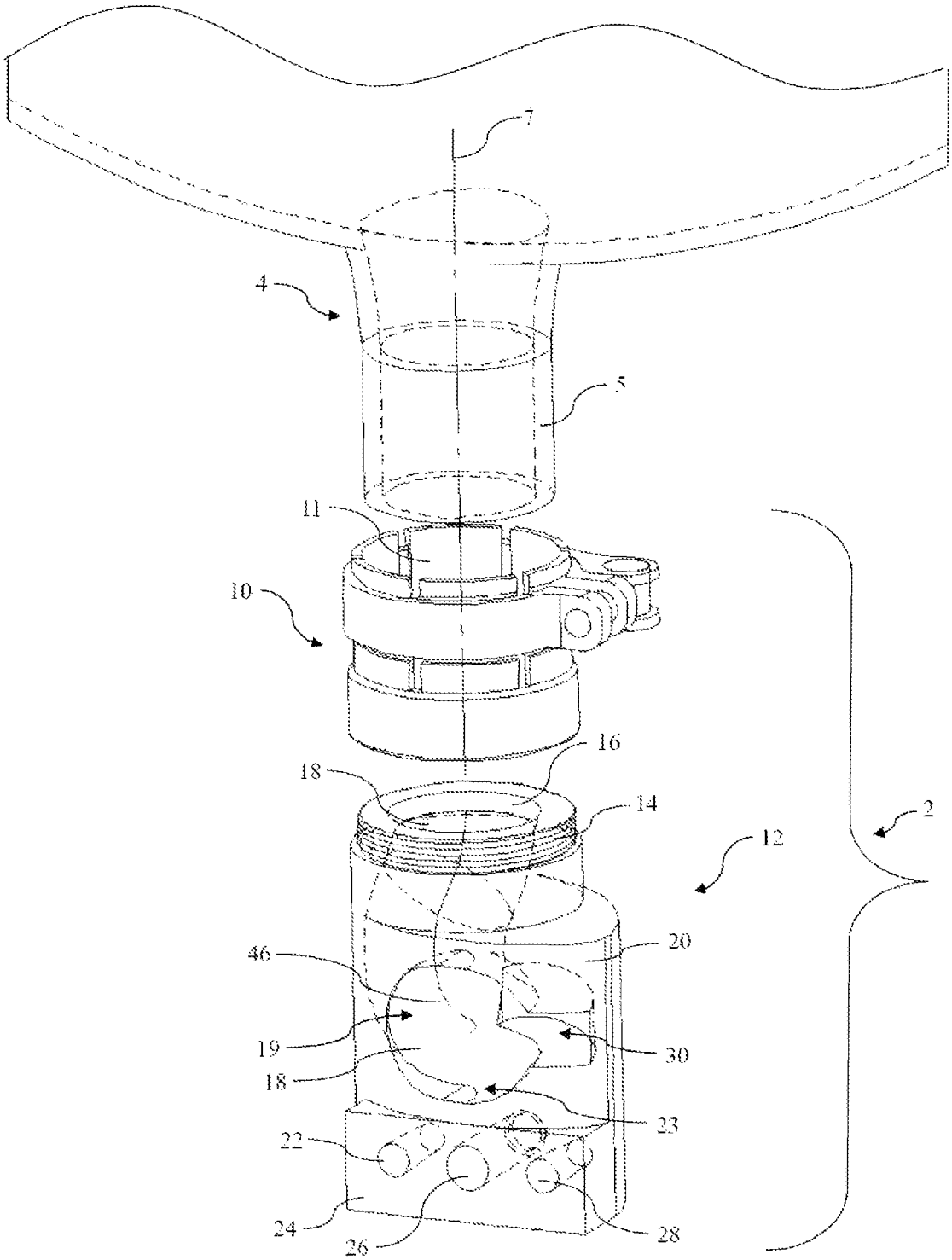
FIG. 2 is an exploded perspective view of the helical path connector assembly of FIG. 1 showing the helical path connector body, the hopper mounting element, and a hopper.

As shown in FIG. 2 the helical path paintball delivery connector 2 consists of the helical path connector body 12, henceforth referred to as 'connector body,' and the hopper mounting element 10. The hopper 4 is removably installed onto the connector assembly 2 via the hopper mount 10 by which the hopper neck 5 is supported and fixed in position along the surface 11 comprising the inner diameter of the hopper mount 10. The hopper 4, hopper mount 10, and connector body 12 are aligned axially along the vertical axis 7 where the start of the helical path 46 is tangent to the liner axis 7. The hopper mount 10 is a component or assembly, of generic fit, form, and function established in the art, which may be removably attachable to or permanently integrated with the connector body 12. In the illustrated embodiment the hopper mount 10 is removably attached to the connector body 12 at an attachment feature 14. The attachment feature 14 may vary in design and employ fastening techniques such as threading shown in this embodiment, snap or rotational locks, clamps, and compression fits to accommodate design elements of the appropriately designed hopper mount 10.

In FIG. 2 the connector body 12 may be a single body, as shown in the illustrative embodiment, or an assembly. The connector 2 could be manufactured using metals, plastics, or composite materials by means of conventional machining, molding, casting, or various forms of three dimensional rapid prototyping or any combination thereof. The connector 2 is the functional interface between the marker 8 in FIG. 1 and a hopper 4 in the hopper mount 10 of FIG. 2. The connector body 12 consists of internal and external geometry uniquely tailored to the geometric features of the corresponding marker 8.

Figure 3:
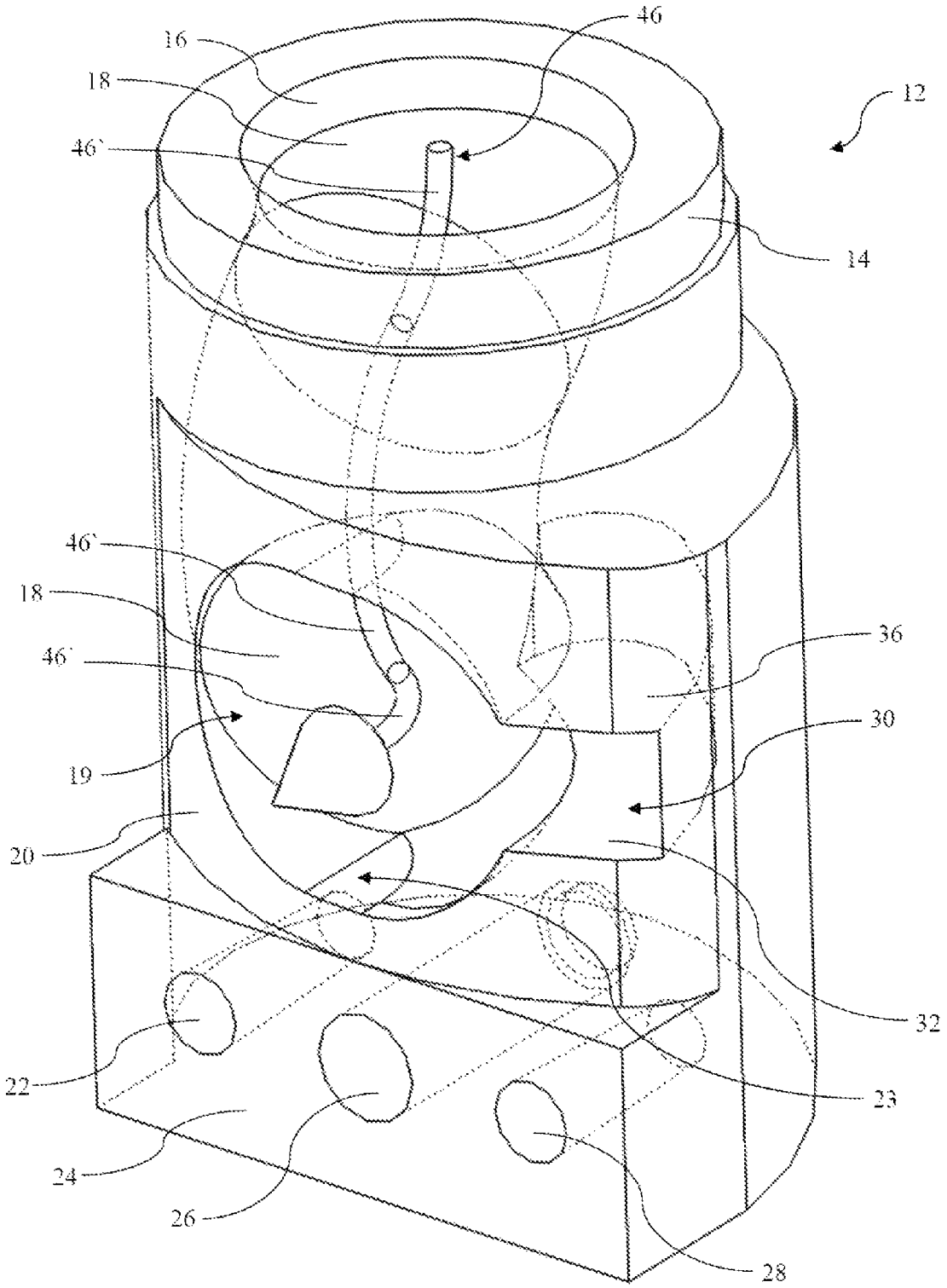
FIG. 3 is a perspective view of the connector body of FIG. 2 with dashed lines showing internal geometries and a demonstrative helical path arrow.
Figure 4:
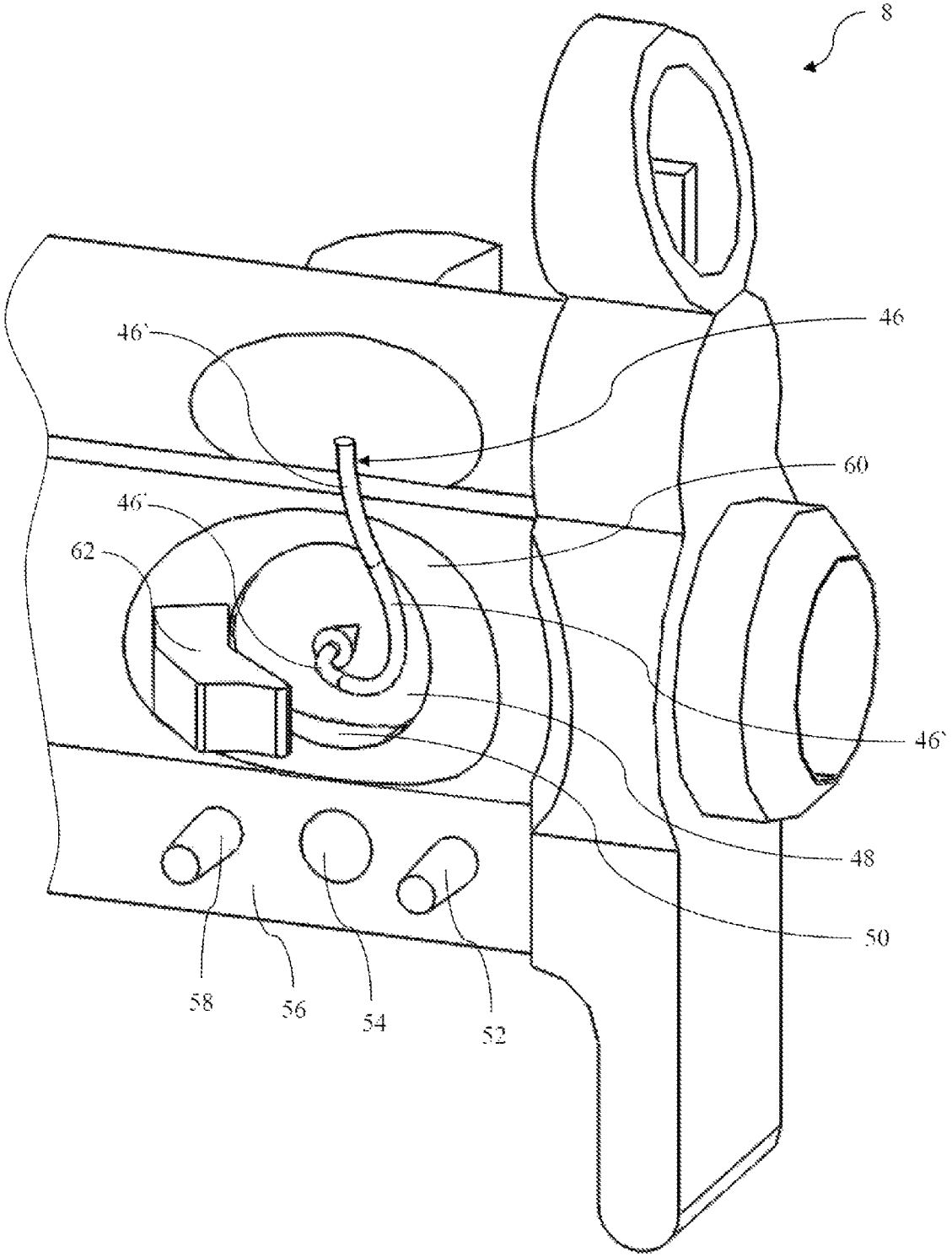
FIG. 4 is a perspective view of a portion of the paintball marker of FIG. 1 showing mating surfaces and features with a representative helical type flow path arrow.
Figure 5:
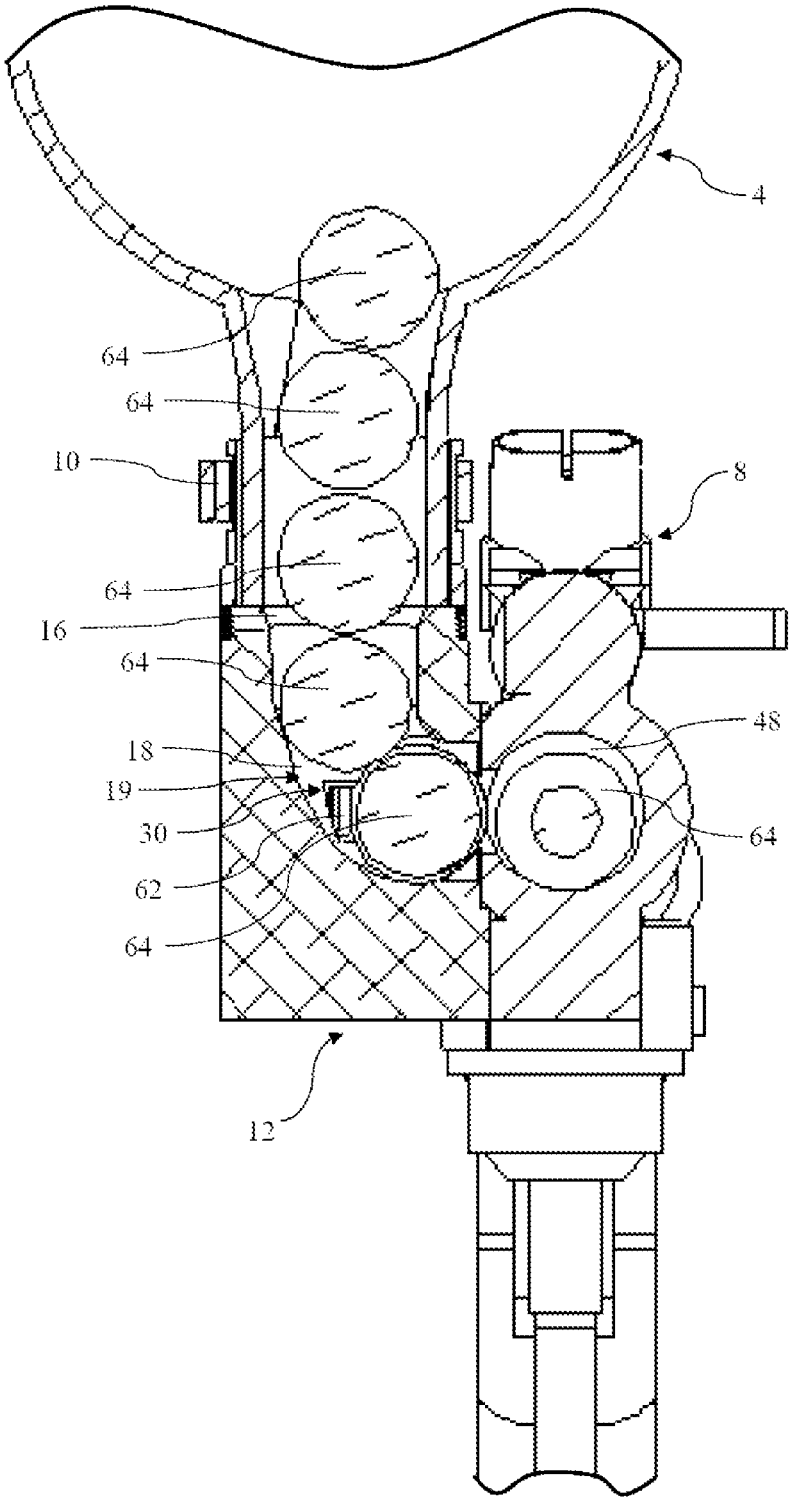
FIG. 5 is a rear looking partial cross sectional view at a plane perpendicular to the lower marker mounting surface 24 of the connector body 12 and aligned coincident to the vertical axis 7 in FIG. 2, showing the paintball path from the hopper to the marker through the helical path connector body.

Paintballs exit the hopper 4 and flow through the connector along an internal geometric cavity 19 comprising a plurality of linked surfaces 18 shown in FIGS. 2, 3, and 5 to the paintball marker 8 breach opening 50 in FIG. 4. The aforementioned cavity is the helical paintball delivery path 19 of the present invention.

The helical paintball delivery path 19 of FIG. 3, henceforth referred to as 'helical cavity,' is a cut away sweep through the connector 12. Paintballs from a hopper 4 removably attached to the connector 2 flow through the hopper mount 10 along the axis 7 shown in FIG. 2 directly into the connector body 12. Once in the connector the paintballs move along the surfaces 18 of the helical cavity 19. The helical cavity 19 follows a complex curve 46 as illustrated in FIG. 3. The curve 46 is continuous with a plurality of segments 46' through any or all axes of a coordinate system. The curves or arc segments 46' which comprise the curve 46 may have variable pitch, angle, radius, arc length, and end point locations in space. The curve segments 46' are generally aligned tangentially between segments resulting in a smooth curve profile. The combination of the plurality of segments 46' and varying parameters are tuned to produce a path 46 required for smooth delivery of paintballs to the marker 8 when obstacles such as a protrusion 62 shown in FIG. 4 prevent a linear path from the hopper 4 to the marker 8 in FIG. 1. The helical cavity 19 generally comprises of a circular cross section which is aligned perpendicular to the helical path 46 and swept along the path 46 through the connector body 12 resulting in the helical cavity 19. A tapered lead in 16 shown in FIGS. 3 and 5 at the hopper opening, like a chamfer, at the top of the connector body 12 provides a smooth transition between the hopper 4 and helical path flow surfaces 18 of the connector body 12 to ensure no paintball 64 damage during use as demonstrated in FIG. 5.

The connector body 12 is removably attached to a region of the paintball marker 8 and is fixed rigidly to the marker 8 during use. The connector body 12 is designed to mate with the surface(s) of the paintball marker and rigidly attached using the markers existing features. In the illustrative embodiment of the present invention the connector body 12 curved mating surface 20 shown in FIG. 3, mates with the curved mounting surface 60 on the marker 8 shown in FIG. 4. The mating surfaces 20 and 60 in FIGS. 3 and 4 respectively have similar profiles such that the two mating surfaces 20 and 60 rest against each other as shown in FIG. 6

Figure 6:
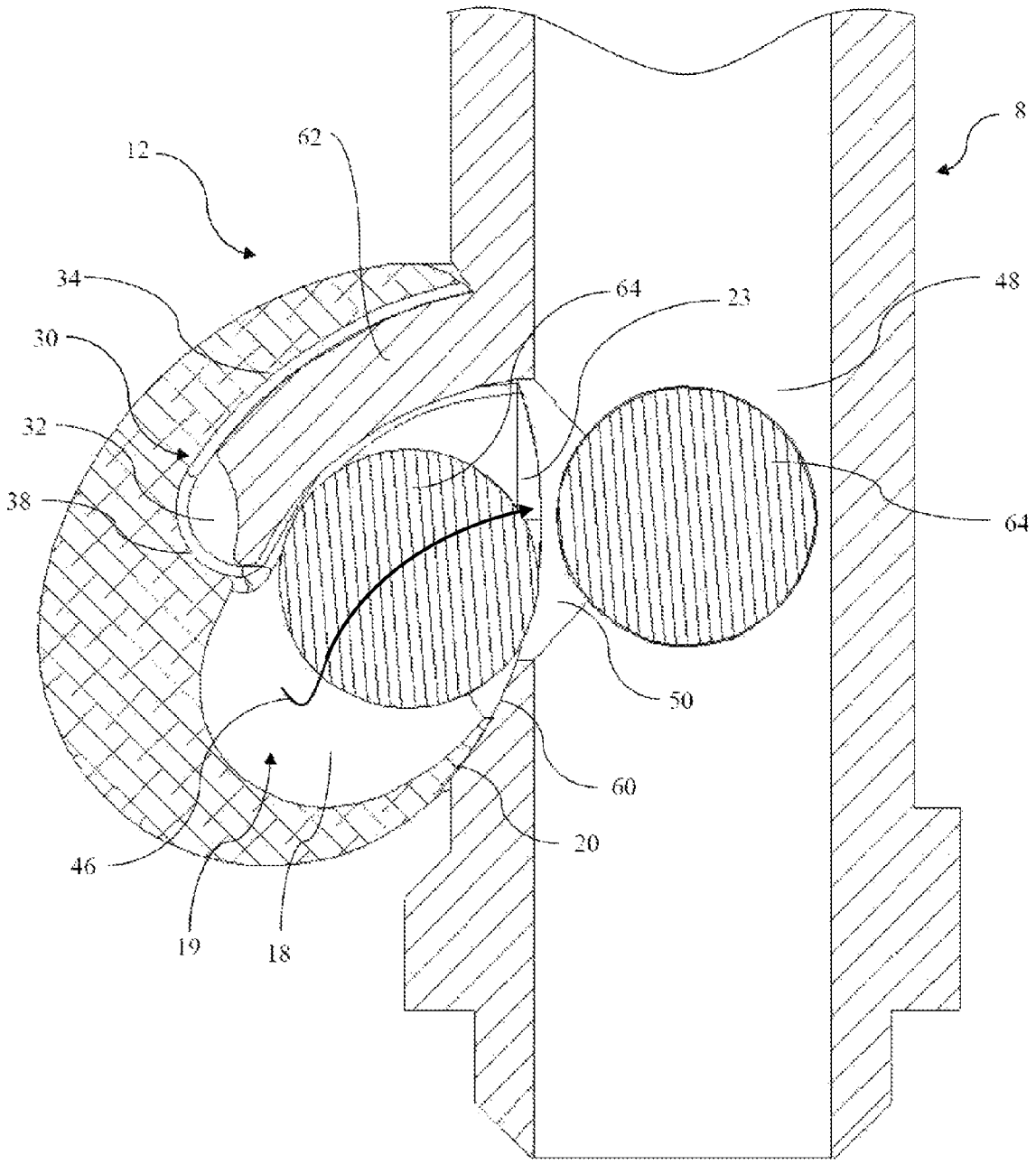
FIG. 6 is a partial top cross-sectional view of the paintball marker and connector of FIG. 1 showing the connector's helical type flow path into the breach of the paintball marker's firing chamber.

A recessed pocket 30 shown in FIGS. 3 and 6 along side of the helical cavity 19 provides adequate clearance for a protrusion 62 from the side of the paintball marker 8 illustrated in FIGS. 4 and 6. The protrusion 62 serves no purpose in the application of the helical path paintball delivery connector 2. The recessed pocket 30 allows use of the connector 2 without requiring removal of the protrusion 62, which would be a destructive and permanent modification to the paintball marker 8 preventing the user from reverting back to the paintball marker 8 manufacturer's factory hopper application. The recessed pocket is aligned such that the protrusion 62 is fully encompassed in the connector body 12. The recessed pocket 30 is comprised of a top surface 36, bottom surface 32, back side surface 34, and end surface 38. The surfaces 32, 34, 36, and 38 are offset from the protrusion 62 such that the connector body 12 can be removably attached to the paintball marker 8 without interference or contact between the recessed pocket 30 and the protrusion 62. The section view in FIG. 6 shows the protrusion 62 residing in the pocket 30 with clearance for the back side 34 and end 38 surfaces. The section view also shows that the protrusion 62 does not cross into the helical cavity 19 or flow path surfaces 18.

FIG. 5 contains an illustrated representation of a series of paintballs 64 along a flow path from the hopper 4 across the tapered lead in 16 and through the connector body 12 inside of the helical cavity 19 to the paintball marker breach 48. The varying depth of cut on paintballs 64 in the section view of FIG. 5 is representative of their movement along the helical path 46 of FIG. 3 in all three dimensions.

FIG. 6 shows a different section view illustrating paintballs 64 winding along the helical path 46 inside the cavity 19 and passing next to a protrusion 62 then exiting through the connector exit 23 into the breach 48 of the paintball marker 8 for firing. At the end of the helical path 46 and cavity 19 is the exit port 23 from which paintballs 64 flow into the marker 8. The exit point 23 is aligned such that the final segment 46', of FIG. 3, of the helical path 46 is aligned to the center of the breach opening 50 for smooth transition into the marker breach 48. FIG. 3 illustrates the preferred embodiment of the exit port 23 as elongated from the circular cross section of the helical cavity 19 for effective mating and smooth transition of paintballs 64 into the paintball marker 8 shown in FIG. 6.

Figure 7:
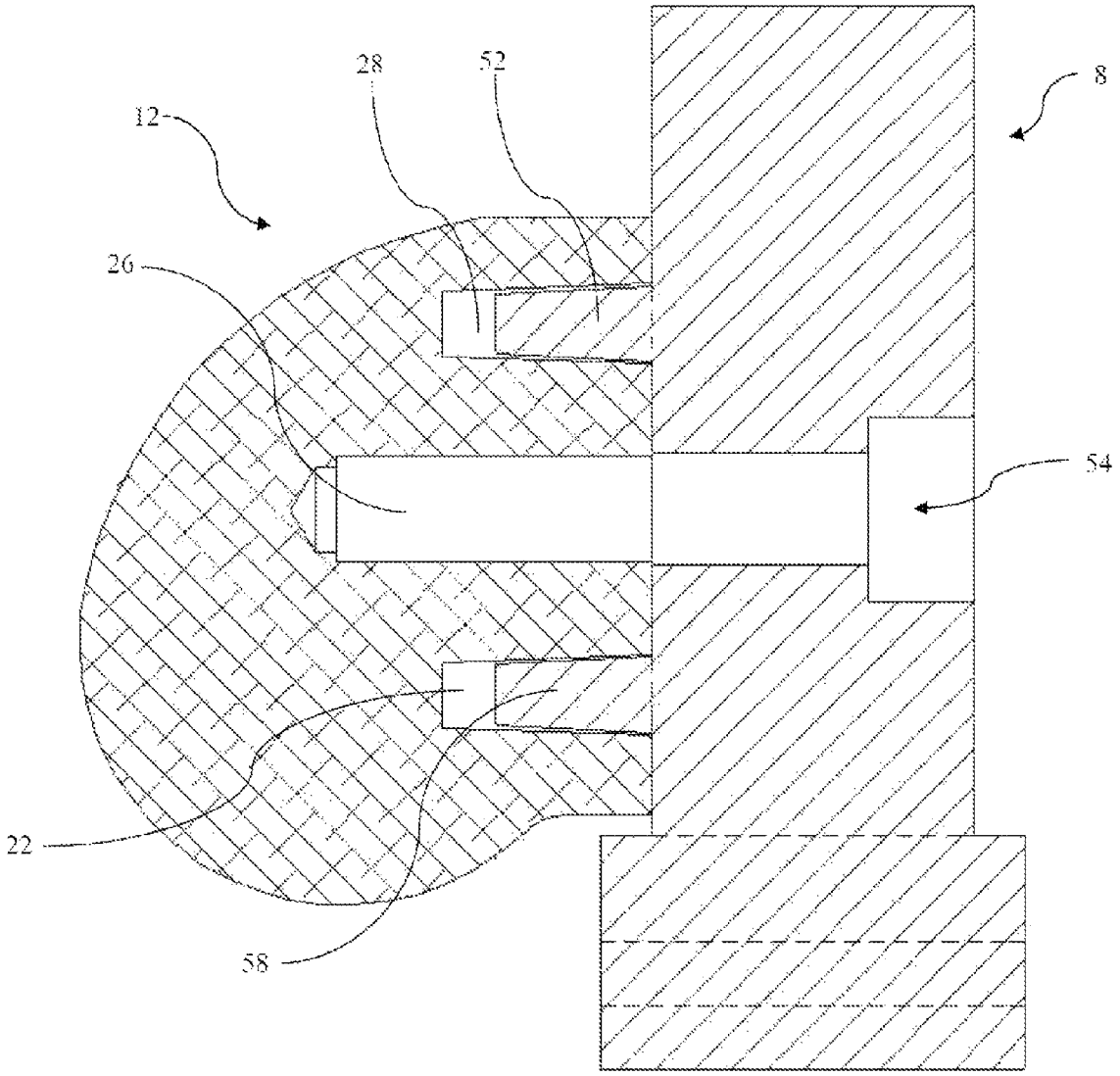
FIG. 7 is a partial top cross-sectional view of the paintball marker and connector of FIG. 1 showing the connector body and marker's locating and mounting features.

The connector body 12 is removably attached to the paintball marker 8. The connector body's lower mounting surface 24 aligns with and when attached is coincident to the marker lower mounting surface 56 shown in FIGS. 3 and 4 respectively. The connector body 12 in FIG. 3 has two holes 22 and 28 which are positioned along the mounting surface 24 such that when installed the connector body 12 is properly aligned with all other mating surfaces and features. The two locating holes 22 and 28 of the illustrated embodiment are circular with an appropriately sized diameter to accept with minimal to no surface contact or interference, the two locating pins 52 and 58 protruding from the marker mounting surface 56 in FIG. 4. Between the locating holes 22 and 28 in FIG. 3 there is a threaded bolt hole 26, which is aligned with the bolt hole 54 on the paintball marker 8 in FIG. 4. The threaded hole 26 serves as the rigid mount for the connector 2, which utilizes the original mounting hardware furnished by the paintball marker 8 manufacturer. FIG. 7 shows an example of fit and alignment of the locating pins 52 and 58 on the marker 8 inside the mating holes 22 and 28 in the connector body 12, as well as the general form and alignment of the paintball marker's bolt clearance hole 54 and corresponding threaded mounting hole 26 in the connector body 12. When the connector 2 is removably attached to the marker 8 the bolt is tightened resulting in a firm marker 8 to connector 2 assembly ready for use.

Exterior non-mounting surfaces not explicitly identified or defined are designed to provide an enclosure for the critical internal geometry, structural strength, aesthetic appeal, and the necessary geometric connections between surfaces.

What is claimed is:

1. A connector for facilitating non-linear transfer of paintballs between a paintball marker and a paintball hopper, the connector comprising:

a rigid body attached to a paintball marker and hopper through which paintballs flow;

a cavity through the body with a circular cross section that translates normal to a helical path through the body which allows for proper position, speed, and directional flow of paintballs; and a pocket contiguous to the cavity that coordinates with physical characteristics of the paintball marker.

2. The connector of claim 1, wherein the helical path of the cavity has an inlet opening coincident to an exterior surface of the body and aligned collinearly to an axis of a paintball hopper outlet.

3. The connector of claim 2, wherein the inlet opening is positioned and sized to receive paintballs flowing from the hopper outlet into the cavity.

4. The connector of claim 1, wherein the cavity has an outlet opening coincident to an exterior surface of the body and aligned to a paintball marker inlet breach opening.

5. The connector of claim 1, wherein the circular cross section of the cavity has a diameter greater than a paintball.

6. The connector of claim 1, wherein the helical path of the cavity is a plurality of tangentially aligned curves between an inlet opening and an outlet opening of the body.

7. The connector of claim 1, wherein the pocket is additional volume of the cavity residing within the body adjacent to the helical path of the cavity.

8. The connector of claim 1, wherein the body includes a mounting element comprising a plurality of mounting elements which communicate with and secure a hopper outlet aligned to a helical path inlet opening and a helical path outlet opening is incident upon a marker inlet breach opening.

9. The connector of claim 8, wherein the body encapsulates the cavity, mounting elements, and pocket as a unified component.

10. The connector of claim 1, wherein the body is shaped to align with the paintball marker and hopper such that no interference exists and no permanent modification is required.

* * * * *